United States Patent [19]

Malloy, III

[11] Patent Number: 4,766,682

[45] Date of Patent: Aug. 30, 1988

[54] REMOVABLE LACE COVER STRAP

[76] Inventor: J. Michael Malloy, III, 31036 Pickwick, Birmingham, Mich. 48009

[21] Appl. No.: 34,627

[22] Filed: Apr. 6, 1987

[51] Int. Cl.[4] ..... A43B 5/00; A43B 23/00; A43C 7/06

[52] U.S. Cl. ..... 36/132; 36/50; 36/136

[58] Field of Search ..... 36/1, 2 R, 2 B, 101, 36/114, 133, 136, 137, 96, 132, 88, 91, 50, 97, 110, 70 R, 51, 72 R; 2/DIG. 6; D2/314; 128/80 R, 80 H, 80 D, 166, 166.5, DIG. 15

[56] References Cited

U.S. PATENT DOCUMENTS

| | | | |
|---|---|---|---|
| 3,104,479 | 9/1963 | D'Amico | 2/DIG. 6 |
| 3,534,957 | 10/1970 | Norman et al. | 128/DIG. 15 X |
| 4,065,861 | 1/1978 | Pelfrey | 36/133 |
| 4,079,527 | 3/1978 | Antonious | 36/51 |
| 4,085,746 | 4/1978 | Castiglia | 128/DIG. 15 X |
| 4,114,297 | 9/1978 | Famolare | 36/50 |
| 4,282,657 | 8/1981 | Antonious | 36/114 X |
| 4,288,930 | 9/1981 | Bornell | 36/132 |
| 4,411,077 | 10/1983 | Slavitt | 36/114 X |
| 4,458,431 | 7/1984 | Sinclair | 36/50 |
| 4,461,288 | 7/1984 | Curtis | 128/166 X |
| 4,550,511 | 11/1985 | Gamm | 36/50 |
| 4,640,025 | 2/1987 | De Renzo | 36/114 X |

*Primary Examiner*—Stuart S. Levy
*Assistant Examiner*—Thomas R. Hannon
*Attorney, Agent, or Firm*—Harness, Dickey & Pierce

[57] ABSTRACT

A removable lace cover strap adapted for use about the instep of a shoe having a knotted lace to prevent the untying thereof, has an elongated strap with an elastic medial portion and opposite end portions with hook and loop fastener patches for attaching the opposite end portions to each other.

5 Claims, 1 Drawing Sheet

FIG. 1.
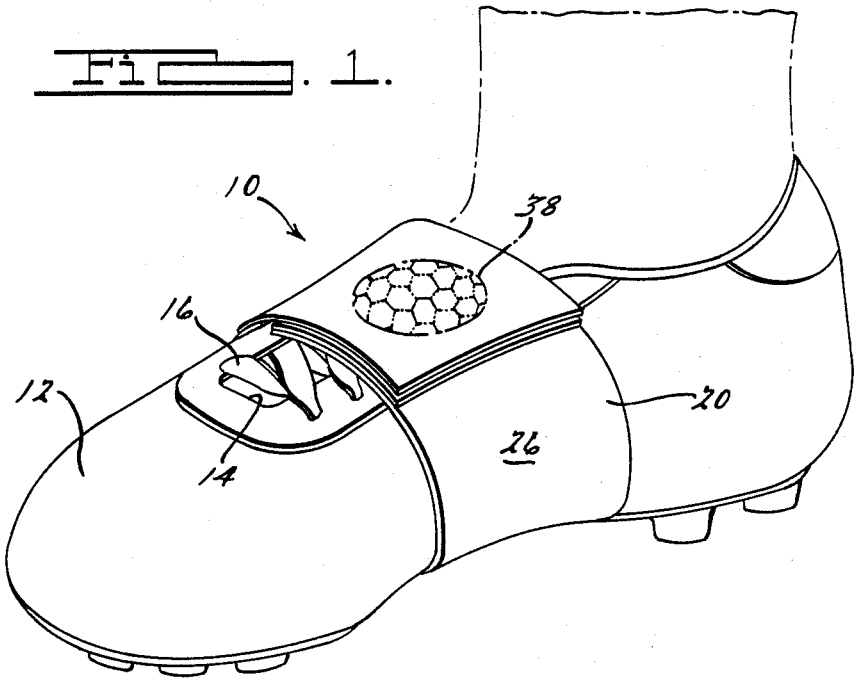
FIG. 2.
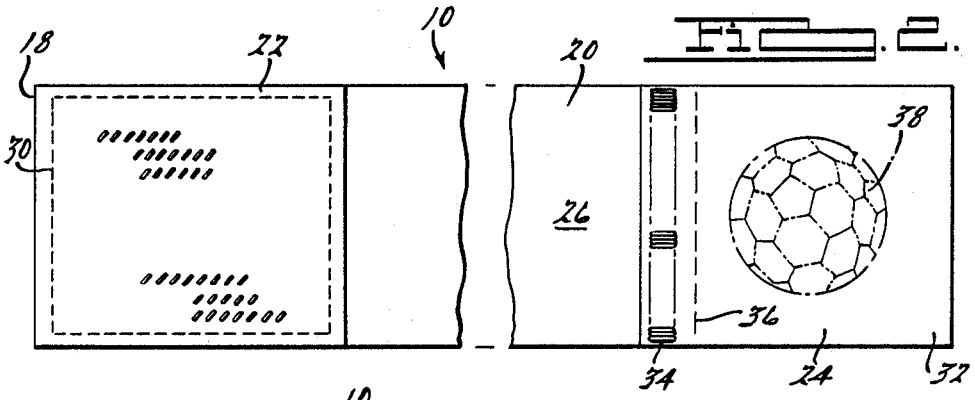
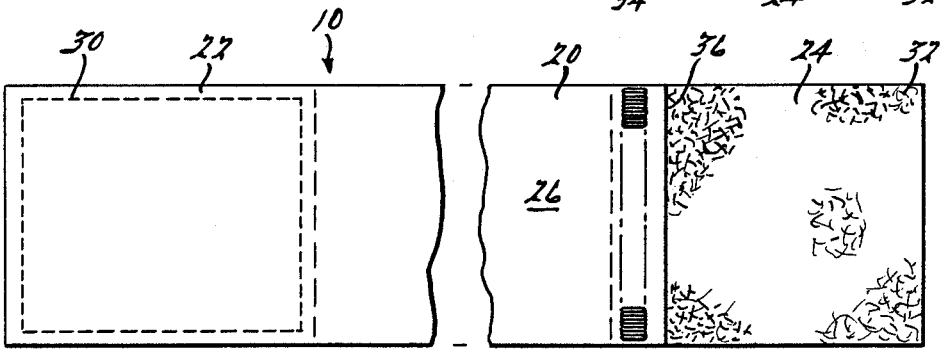
FIG. 3.

REMOVABLE LACE COVER STRAP

BACKGROUND OF THE INVENTION

The present invention relates to footwear accessories. More particularly, the present invention relates to a removable lace cover strap to be placed about the instep of laced footwear to prevent the laces from untying and for decorative purposes.

Athletic shoes commonly employ laces which are drawn tight and tied to provide a relatively tight-fitting shoe. Unfortunately, the generally long, thick laces employed in athletic shoes have a common problem of coming untied during athletic activity. Untied laces lead almost immediately to reduced athletic performance and can be very disadvantageous if the reduced performance occurs at an inopportune time during a game. The untying of laces is especially a problem for young children and in certain sports such as soccer.

Thus, it would be highly desirable if an accessory could be provided which can be easily worn to prevent laces from coming untied. It would be even more desirable if the accessory were decorative and could carry a team logo or the like. In accordance with the present invention, a removable instep strap is provided which can be used as a lace cover strap in conjunction with footwear and particularly with athletic footwear. The removable instep strap has an appropriate length and width and is provided with hook and loop fasteners at opposite ends so that the strap can be worn or removed as desired and can be adjusted. The instep strap has an elastic portion to allow adjustment to foot position during play and, preferably, has an inelastic portion over the laces to minimize the untying thereof.

Further understanding of the present invention can be had from the following description and accompanying drawing.

BRIEF DESCRIPTION OF THE DRAWING

FIG. 1 is a perspective view of a preferred embodiment of the present invention shown in operative association on an athletic shoe.

FIG. 2 is a top plan view, broken away, of the preferred embodiment illustrated in FIG. 1.

FIG. 3 is a bottom plan view, broken away, of the preferred embodiment illustrated in FIGS. 1 and 2.

DESCRIPTION OF THE INVENTION

Now referring to the drawing, the Figures illustrate a removable lace cover strap of the present invention indicated generally by the numeral 10. Strap 10 is illustrated in FIG. 1 in operative association with an athletic shoe 12 such as a soccer shoe. Strap 10 is shown in position about the instep of shoe 12 which has a lacing enclosure 14 with conventional lace 16 with opposite ends knotted in a conventional bow knot with lace knot loops not shown in the Figure.

Generally speaking, strap 10 is an elongated strap with a width about equal to the instep of the shoe and a length just sufficient to allow overlapping opposite ends. Thus, strap 10 includes a medial portion 20 and opposite end portions 22 and 24. Medial portion 20 is comprised of an elastic band 26 selected to maintain strap 10 in slight tension against shoe 12 when strap 10 is secured thereabout. It is, of course, important that the elasticity of elastic band 26 be such that only slight force is required to expand strap 10 during use so that strap 10 is comfortable during use and does not interfere with the athletic performance of the player. End portion 22 carries means for fastening the end portion such as a hook type fastener path 28 as is sold under the Velcro ® trademark. Elastic band 26 extends to the end 18 of strap 10 with hook fastener path 28 sewn by threads 30 or otherwise secured on the top surface thereof as with an adhesive or the like. End portion 24 has cooperating end fastening means such as a loop type fastener patch 32 which cooperates with hook fastener patch 28 to hold opposite ends of strap 10 in a desired attachment relationship. Loop fastener patch 32 is sewn by threads 34 or otherwise attached to end 36 of elastic band 26 with loops facing downwardly so as to cooperate in attachment relationship with hook fastener patch 28 when strap 10 is placed about the instep of shoe 12. Loop fastener patch 32 preferably has a logo 38 or other insignia thereon.

It will be appreciated that in use strap 10 is placed about the instep of shoe 12 and over the loose lace loops to minmize the tendency of the associated knot to become untied. Strap 10 preferably covers the lace knot itself. However, it has been found that the untying tendency of the lace knot will be minimized even where strap 10 covers the loose lace loops but not the knot itself. The medial portion 20 of strap 10 is comprised of an elastic material so that when a person is engaged in athletic activity, the strap 10 can stretch accordingly so as to prevent any discomfort while retaining strap 10 in place about the instep of the player. The overlapping end portions of strap 10 preferably are not elastic so as to minimize any flexing of strap 10 over the lace loops which would tend to loosen the associated knot. For example, when an opponent or a ball contacts the instep of the shoe, strap 10 rather than the lace loops will sustain the friction from the contact and the knot will not be drawn apart. In this regard it should be further noted that strap 10 provides an improved contact surface for kicking a ball such as a soccer ball. The relatively even ball contacting surface provided by strap 10 is preferable to that of the laces themselves to provide more ball control.

It is another advantage of the present invention that strap 10 can be characterized with a desired design or decoration. Thus, loop fastener patch 32 preferably has a decorative item such as a soccer ball 38, or alternatively a loop or other insignia thereon for identifcation or decorative purposes. Elastic band 26, hook fastener patch 28 and loop fastener patch 32 can be of colored material to further enhance the appearance of strap 10. Thus, strap 10 can be made of team logos and colors to comprise part of a team uniform. It is contemplated that in practicing the present invention, strap 10 will have decorative features so as to be appealing to consumers and to aid in team identification.

It will be appreciated that while the present invention has been described substantially in connection with shoes adapted for the game of soccer, straps 10 are readily adaptable for use with any athletic shoe or other shoe where it is desired to prevent untying of laces or to obtain a decorative look. It will be appreciated that the present invention is subject to variation and modification. For example, the hook type fastener patch and loop type fastener patch could be interchanged. Thus the foregoing disclosure is set forth to illustrate but not limit the present invention which is limited only by the spirit and scope of the following claims.

What is claimed is:

1. In combination with a cleated shoe having lace knot loops, a removable lace cover strap positioned about the instep of said shoe and covering the loose lace knot loops thereof, said strap comprising a single elongated strap with an elastic medial portion and opposite end portions with means for attaching said opposite end portions to each other.

2. A step as in claim 1 wherein said means for attaching opposite end portions comprises respective hook and loop fastener patches.

3. A strap as in claim 2 wherein said end portions are not elastic.

4. A strap as in claim 3 wherein said strap has top and bottom faces and opposite end edges and one of said hook and loop fastener patches is secured onto one of said faces proximate to one of said opposite end edges and the other of said patches is secured to the other of said opposite end edges.

5. A strap as in claim 4 wherein said patches are theadably secured to said face and edge.

* * * * *

UNITED STATES PATENT AND TRADEMARK OFFICE

CERTIFICATE OF CORRECTION

PATENT NO. : 4,766,682

DATED : August 30, 1988

INVENTOR(S) : J. Michael Malloy, III

It is certified that error appears in the above-identified patent and that said Letters Patent is hereby corrected as shown below:

Column 2, line 3, "path" should be --patch--

Column 2, line 5, "path" should be --patch--

Column 2, line 20, "minmize" should be --minimize--

Column 3, line 9, "step" should be --strap--

Signed and Sealed this

Fourth Day of April, 1989

*Attest:*

*Attesting Officer*

DONALD J. QUIGG

*Commissioner of Patents and Trademarks*